US007690785B2

(12) United States Patent
Silverbrook

(10) Patent No.: US 7,690,785 B2
(45) Date of Patent: Apr. 6, 2010

(54) PAGER WITH BUILT-IN PRINTER

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 268 days.

(21) Appl. No.: 10/503,898

(22) PCT Filed: Feb. 12, 2003

(86) PCT No.: PCT/AU03/00145

§ 371 (c)(1),
(2), (4) Date: Aug. 9, 2004

(87) PCT Pub. No.: WO03/069930

PCT Pub. Date: Aug. 21, 2003

(65) Prior Publication Data

US 2005/0146592 A1 Jul. 7, 2005

(30) Foreign Application Priority Data

Feb. 13, 2002 (AU) ..... PS 0487

(51) Int. Cl.
*B41J 3/36* (2006.01)

(52) U.S. Cl. ..... 347/109; 347/108

(58) Field of Classification Search ..... 347/109, 347/108, 101; 400/88, 556.1, 557, 90.2
See application file for complete search history.

(56) References Cited

U.S. PATENT DOCUMENTS

| | | | | |
|---|---|---|---|---|
| 5,501,535 | A * | 3/1996 | Hastings et al. | 347/109 |
| 5,593,236 | A * | 1/1997 | Bobry | 347/109 |
| 5,927,872 | A | 7/1999 | Yamada | |
| 5,988,900 | A | 11/1999 | Bobry | |
| 6,229,565 | B1 | 5/2001 | Bobry | |
| 6,543,893 | B2 * | 4/2003 | Desormeaux | 347/109 |
| 2001/0000172 | A1 | 4/2001 | Barrus et al. | |

FOREIGN PATENT DOCUMENTS

| | | | |
|---|---|---|---|
| DE | 4444295 | A1 | 6/1996 |
| JP | 07-222223 | | 8/1995 |
| JP | 10-016313 | | 6/1998 |
| JP | 11-034432 | | 2/1999 |
| KR | 2002-0011693 | A | 2/2002 |
| TW | 446900 | B | 7/2001 |
| WO | WO 0141480 | A1 * | 6/2001 |

* cited by examiner

*Primary Examiner*—Manish S Shah

(57) ABSTRACT

A digital pager has a built-in printer to enable the printing of a text message and/or a graphic image upon a page as the pager housing traverses the page. The pager can be maintained compact and lightweight as no paper storage or paper feed mechanism need be provided.

7 Claims, 6 Drawing Sheets

PAGER WITH BUILT-IN PRINTER

CROSS-REFERENCES TO RELATED APPLICATIONS

The present application is a 371 of PCT/AU03/00145 filed on Feb. 12, 2003.

FIELD OF THE INVENTION

The following invention relates to pager technology. More particularly, though not exclusively, the invention relates to a pager having a built-in printer. Such a printer might be a drop-on-demand inkjet printer utilizing a fixed printhead system.

BACKGROUND

Known pagers have a display panel upon which messages are displayed. However, no means of conveniently producing a print-out of the message is heretofore known.

The mere incorporation into a pager housing of a known printer device would not result in a compact, easily portable pager. This is because prior art printers incorporate a supply of print media and employ a print media feed mechanism to transport the print media past the printheads to effect printing onto the print media. Such known printers, having a supply of print media, are large and heavier than would be desirable in a portable pager.

CO-PENDING APPLICATIONS

Various methods, systems and apparatus relating to the present invention are disclosed in the following co-pending applications filed by the applicant or assignee of the present invention simultaneously with the present application:

| | | |
|---|---|---|
| PCT/AU03/00154 | PCT/AU03/00151 | PCT/AU03/00150 |
| PCT/AU03/00145 | PCT/AU03/00153 | PCT/AU03/00152 |
| PCT/AU03/00168 | PCT/AU03/00169 | PCT/AU03/00170 |
| PCT/AU03/00162 | PCT/AU03/00146 | PCT/AU03/00159 |
| PCT/AU03/00171 | PCT/AU03/00149 | PCT/AU03/00167 |
| PCT/AU03/00158 | PCT/AU03/00147 | PCT/AU03/00166 |
| PCT/AU03/00164 | PCT/AU03/00163 | PCT/AU03/00165 |
| PCT/AU03/00160 | PCT/AU03/00157 | PCT/AU03/00148 |
| PCT/AU03/00156 | PCT/AU03/00155 | |

The disclosures of these co-pending applications are incorporated herein by cross-reference.

RELATED PATENT APPLICATIONS AND PATENTS

| | | | | |
|---|---|---|---|---|
| 6,566,858 | 6,331,946 | 6,246,970 | 6,442,525 | PCT/AU01/00141 |
| 09/505,951 | PCT/AU01/00139 | 6,816,968 | 6,757,832 | PCT/AU01/00140 |
| PCT/AU00/00741 | 6,238,044 | PCT/AU00/00742 | 6,425,661 | 6,227,652 |
| 6,213,588 | 6,213,589 | 6,231,163 | 6,247,795 | 6,394,581 |
| 6,244,691 | 6,257,704 | 6,416,168 | 6,220,694 | 6,257,705 |
| 6,247,794 | 6,234,610 | 6,247,793 | 6,264,306 | 6,241,342 |
| 6,247,792 | 6,264,307 | 6,254,220 | 6,234,611 | 6,302,528 |
| 6,283,582 | 6,239,821 | 6,338,547 | 6,247,796 | 6,557,977 |
| 6,390,603 | 6,362,843 | 6,293,653 | 6,312,107 | 6,227,653 |
| 6,234,609 | 6,238,040 | 6,188,415 | 6,227,654 | 6,209,989 |
| 6,247,791 | 6,336,710 | 6,217,153 | 6,416,167 | 6,243,113 |
| 6,283,581 | 6,247,790 | 6,260,953 | 6,267,469 | 6,273,544 |
| 6,309,048 | 6,420,196 | 6,443,558 | 6,439,689 | 6,378,989 |
| 6,848,181 | 6,634,735 | PCT/AU98/00550 | PCT/AU00/00095 | 6,390,605 |
| 6,322,195 | 6,612,110 | 6,480,089 | 6,460,778 | 6,305,788 |
| PCT/AU00/00172 | 6,426,014 | PCT/AU00/00338 | 6,364,453 | PCT/AU00/00339 |
| 6,457,795 | PCT/AU00/00581 | 6,315,399 | PCT/AU00/00580 | 6,338,548 |
| PCT/AU00/00582 | 6,540,319 | PCT/AU00/00587 | 6,328,431 | PCT/AU00/00588 |
| 6,328,425 | PCT/AU00/00589 | 6,991,320 | PCT/AU00/00341 | 6,595,624 |
| PCT/AU00/00340 | PCT/AU00/00749 | 6,417,757 | PCT/AU01/01332 | 7,095,309 |
| PCT/AU01/01318 | 6,854,825 | PCT/AU00/00750 | 7,075,677 | PCT/AU00/00751 |
| 6,428,139 | PCT/AU00/00752 | 6,575,549 | PCT/AU01/00502 | PCT/AU00/00583 |
| 6,383,833 | PCT/AU02/01120 | PCT/AU00/00593 | 6,464,332 | PCT/AU00/00333 |
| PCT/AU00/01513 | 6,428,142 | PCT/AU00/00590 | 6,390,591 | PCT/AU00/00591 |
| 7,018,016 | PCT/AU00/00592 | 6,328,417 | PCT/AU00/00584 | 6,322,194 |
| PCT/AU00/00585 | 6,382,779 | PCT/AU00/00586 | 6,629,745 | PCT/AU00/01514 |
| 6,565,193 | PCT/AU00/01515 | 6,609,786 | PCT/AU00/01516 | 6,609,787 |
| PCT/AU00/01517 | 6,439,908 | PCT/AU00/01512 | 6,684,503 | PCT/AU00/00753 |
| 6,755,513 | PCT/AU00/00594 | 6,409,323 | PCT/AU00/00595 | 6,281,912 |
| PCT/AU00/00596 | 6,604,810 | PCT/AU00/00597 | 6,318,920 | PCT/AU00/00598 |
| 6,488,422 | PCT/AU01/01321 | 6,655,786 | PCT/AU01/01322 | 6,457,810 |
| PCT/AU01/01323 | 6,485,135 | PCT/AU00/00516 | 6,795,215 | PCT/AU00/00517 |
| 7,154,638 | PCT/AU00/00511 | 6,859,289 | PCT/AU00/00754 | 6,977,751 |
| PCT/AU00/00755 | 6,398,332 | PCT/AU00/00756 | 6,394,573 | PCT/AU00/00757 |
| 6,622,923 | | | | |

DISCLOSURE OF THE INVENTION

According to one aspect of the present invention there is disclosed a pager comprising:

a housing;

a digital storage device adapted to store one or both of text and image data received by the pager;

a printer located within the housing and configured to:

(a) receive digital information from the digital storage device; and (b) print one or both of text and an image on print media external to the printer as the housing traverses said print media.

Preferably, the pager further comprises an antenna via which one or both of said text data and said image data is received.

Preferably, said printer comprises a drop-on-demand color inkjet printhead.

Preferably, the housing has located therein a replaceable ink cartridge communicating with the printhead.

Preferably, the pager has located within the housing a speed sensor including an optical encoder wheel adapted to contact the print media and to rotate as the housing traverses the print media, said optical encoder wheel including a series of circumferential spaced markings thereon, the speed sensor further including an optical sensor for detecting the markings as said markings pass the optical sensor during rotation of the optical encoder wheel.

Preferably, the circumferential spacing between successive markings on the optical encoder wheel is substantially equal to the spacing between successive print lines in at least one of the text and the image being printed by the printhead.

Preferably, detection of a marking on said encoder wheel by the optical sensor triggers the printing of a next line of one or both of text data and image data.

Preferably, the pager further includes a power supply located within said housing. More preferably, the power supply includes a battery removable from the pager.

Preferably, the pager further comprises a display screen adapted to display one or both of the text and the image.

Preferably, the pager further comprises user operable buttons for controlling said printer.

BRIEF DESCRIPTION OF THE DRAWINGS

A preferred form of the present invention will now be described by way of example only with reference to the accompanying drawings, wherein.

DESCRIPTION OF THE PREFERRED EMBODIMENT

Figure 1:
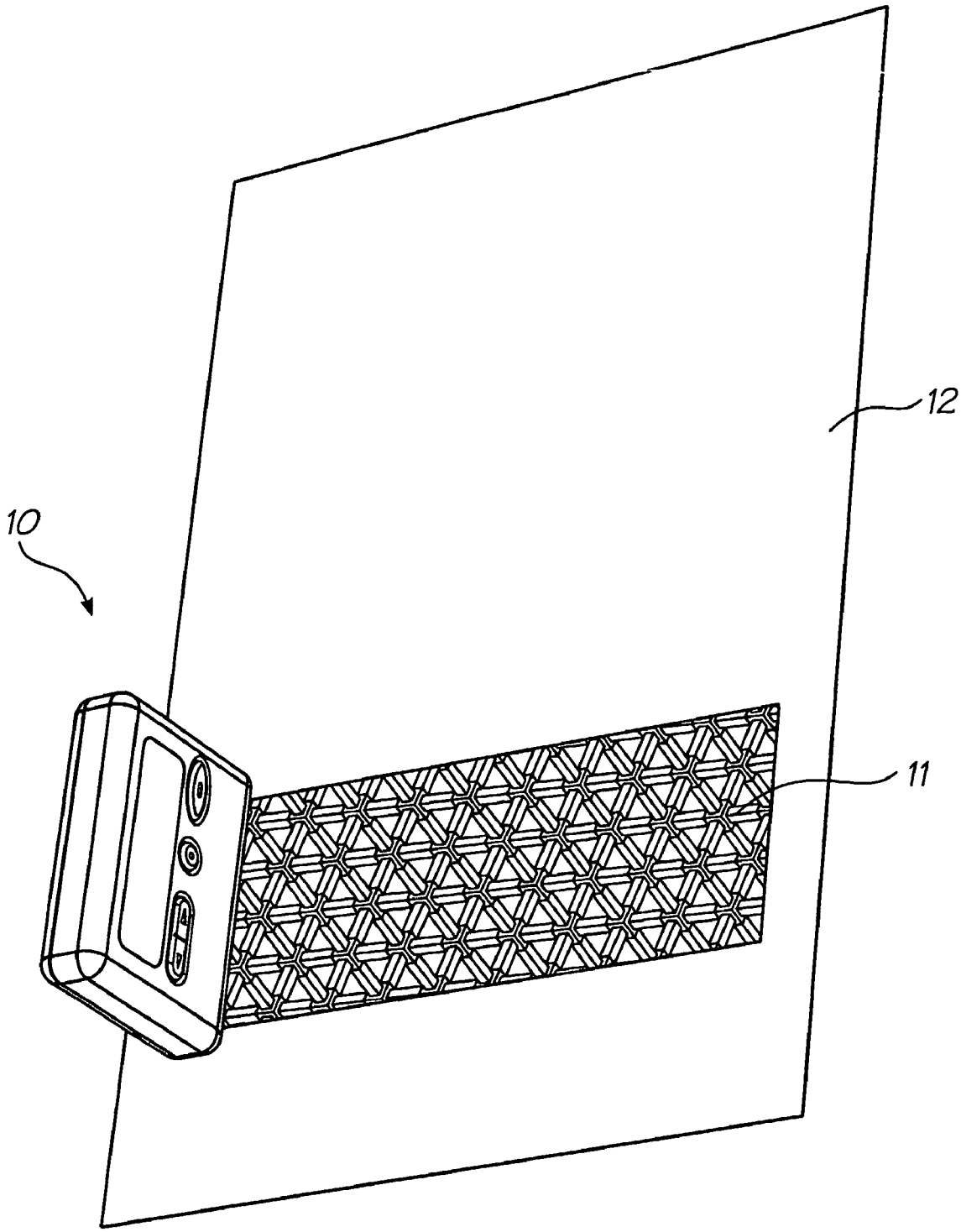
FIG. 1 is a schematic perspective illustration of a pager having a built-in printer, in use traversing a page to print an image thereon.

In FIG. 1 of the accompanying drawings there is schematically depicted a pager 10 having a built-in printer, having almost completely traversed a page of print media 12 to print an image 11 thereon. The pager 10 is a hand-held device that is sized and shaped to fit easily within the pocket or purse, for example, of a user.

Figure 2:
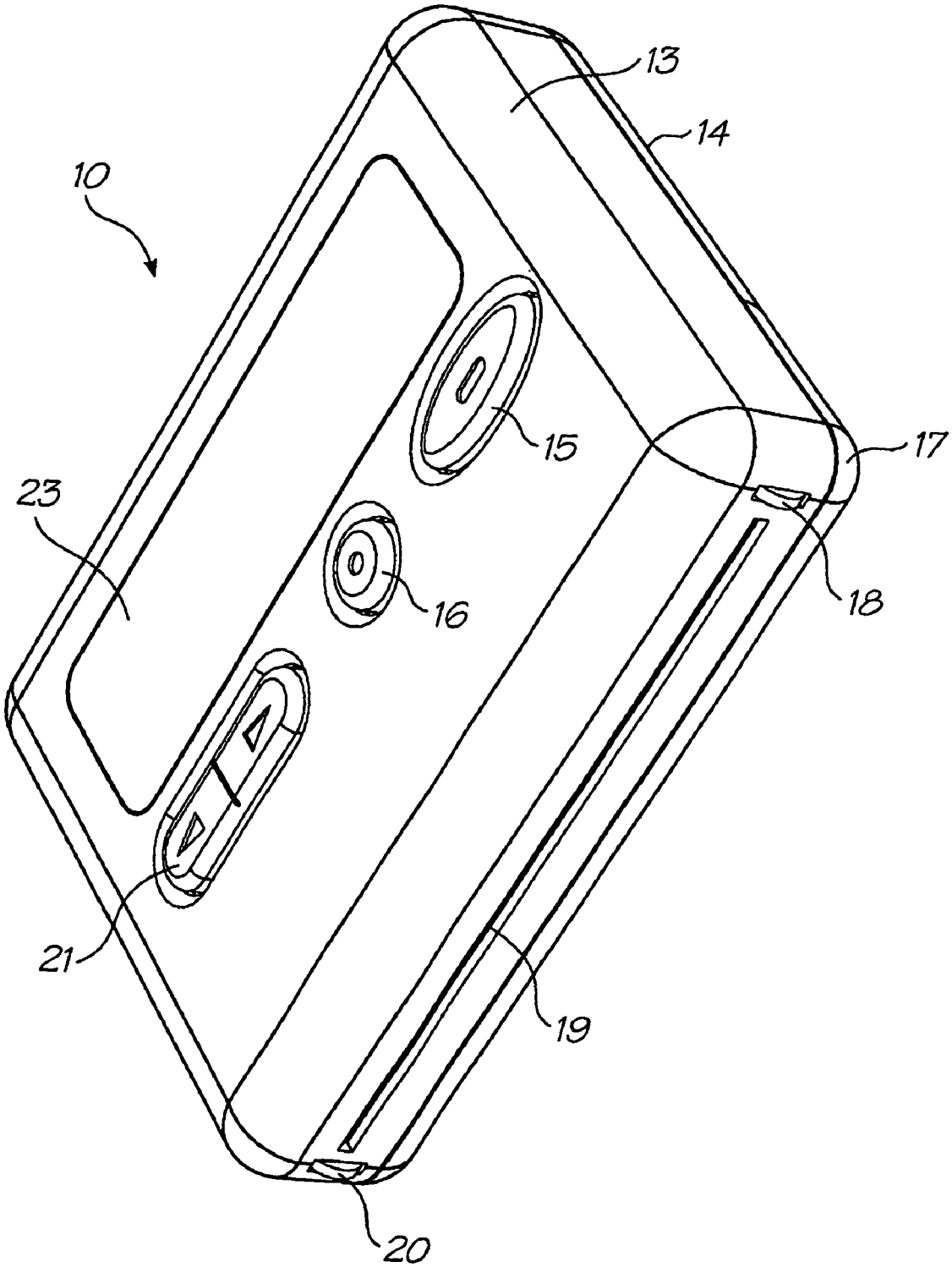
FIG. 2 is a schematic perspective view of a pager.

As shown in FIG. 2, the housing of pager 10 includes a plastics top molding 13 and a base molding 14. The top molding 13 has a display window 23, a pair of scroll buttons 21, a YES/GO button 15 and a NO/STOP button 16.

At the bottom edge of the housing of the pager 10 there is provided an optical encoder wheel 18, an idler wheel 20 and a printhead 19 therebetween. Operation of the printhead, the optical encoder wheel and associated internal componentry can be found in our co-pending application Ser. No. 10/503,900 entitled "Manually Operable Printer-Scanner". Although the printing mechanism utilized in the present invention might be identical to that disclosed in the co-pending application Ser. No. 10/503,900, other forms of small, lightweight printers (yet to be developed) that can print on print media external to the pager housing 10 can be employed.

Figure 3:
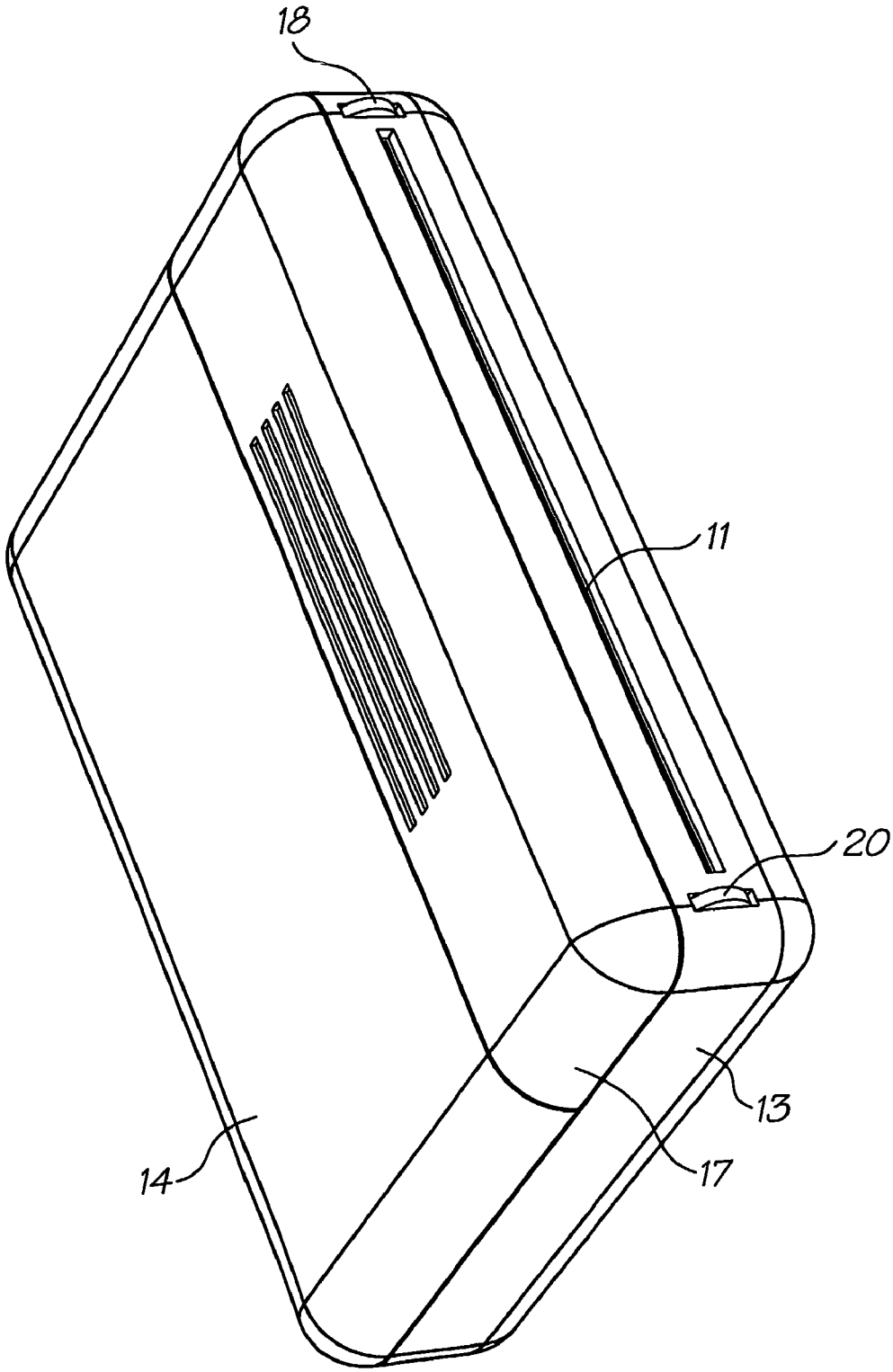
FIG. 3 is a schematic inverted perspective view of the pager of FIG. 2.

As shown in FIG. 3, the base molding 14 has associated therewith a battery/ink cartridge cover molding 17. This would typically reside alongside the printhead 11 as shown.

Figure 4:
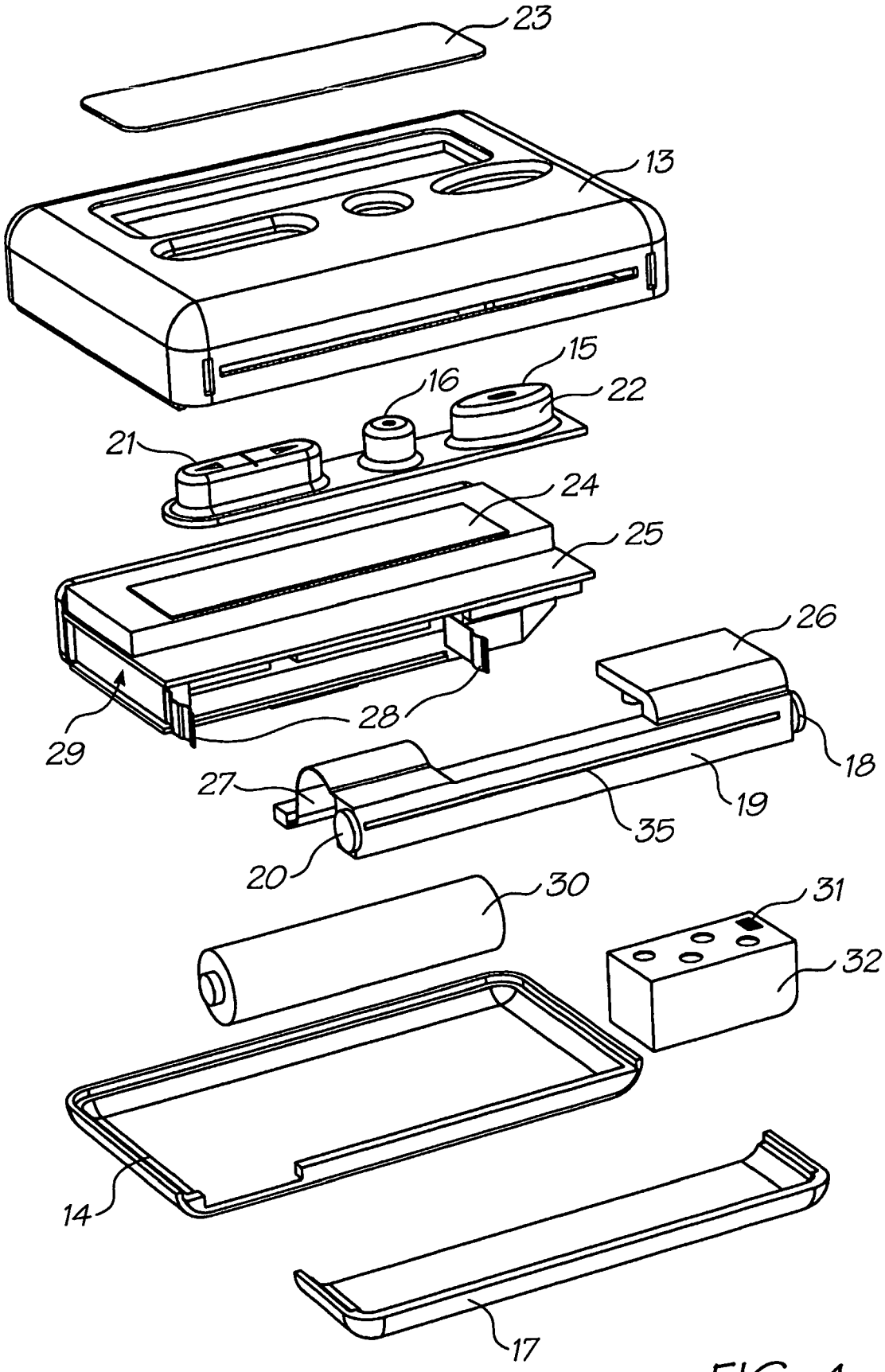
FIG. 4 is a schematic exploded perspective view of the pager of FIGS. 2 and 3.
Figure 5:
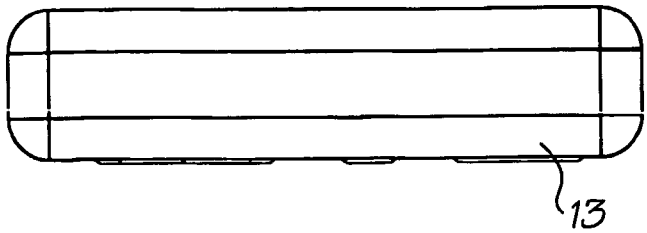
FIG. 5 is a schematic plan view of the pager.
Figure 6:
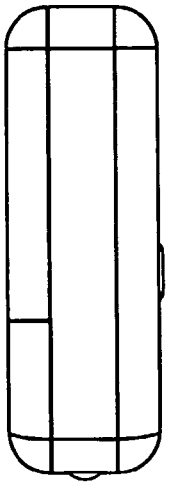
FIG. 6 is a schematic side elevational view of the pager.
Figure 7:
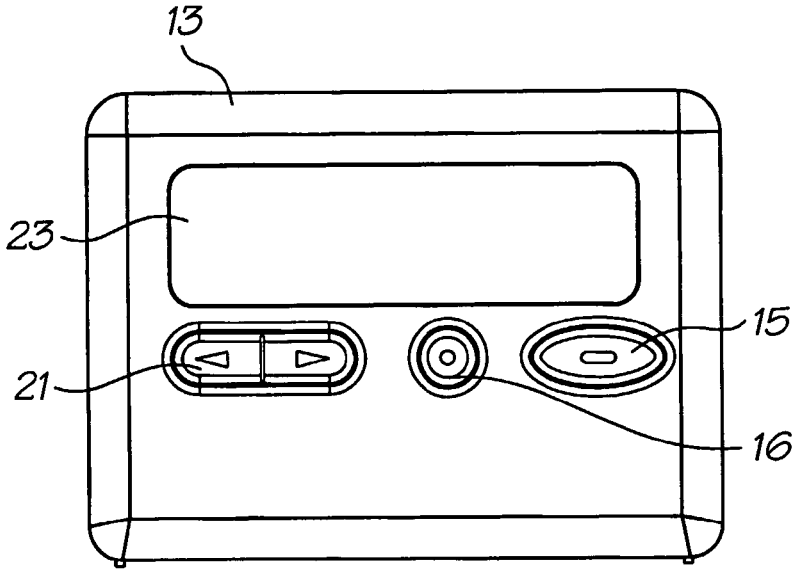
FIG. 7 is a schematic front elevational view of the pager.
Figure 8:
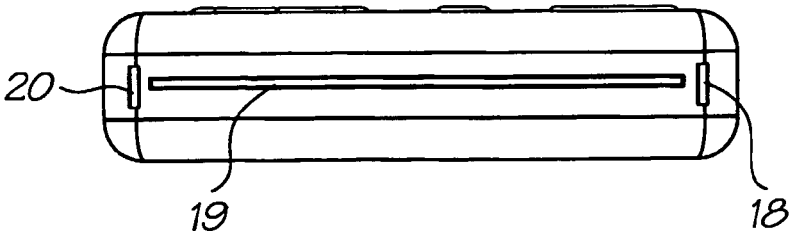
FIG. 8 is a schematic inverted plan view of the pager.

An exploded perspective view of the pager is shown in FIG. 4. Beneath the top molding 13, there is provided an elastomeric button molding 22 to cover the electrical switches of the scroll buttons 21, the YES/GO button 15 and the NO/STOP button 16.

Situated beneath the display window 23, there is provided a liquid crystal display (LCD) 24. LCD 24 is attached to a printed circuit board 25 behind which there is located electronics 29. Power to the printed circuit board 25 and LCD 24 is from a battery 30 via battery contacts 28. Battery 30 might typically be an AAA sized battery. The battery might typically be rechargeable.

Also located within the pager housing and associated with the printhead 9 is a flexible printed circuit board 27 which contacts with the printed circuit board 25 to provide control signals and power to the printhead 19.

Also associated with the printhead 19 is an ink connector 26 to receive ink from an ink cartridge 32. A question/answer (QA) chip 31 on the ink cartridge 32 makes contact with the underside of ink connector 26 to indicate that the cartridge is present If the cartridge is absent, a display warning might be sent to the LCD 24.

Figure 9:
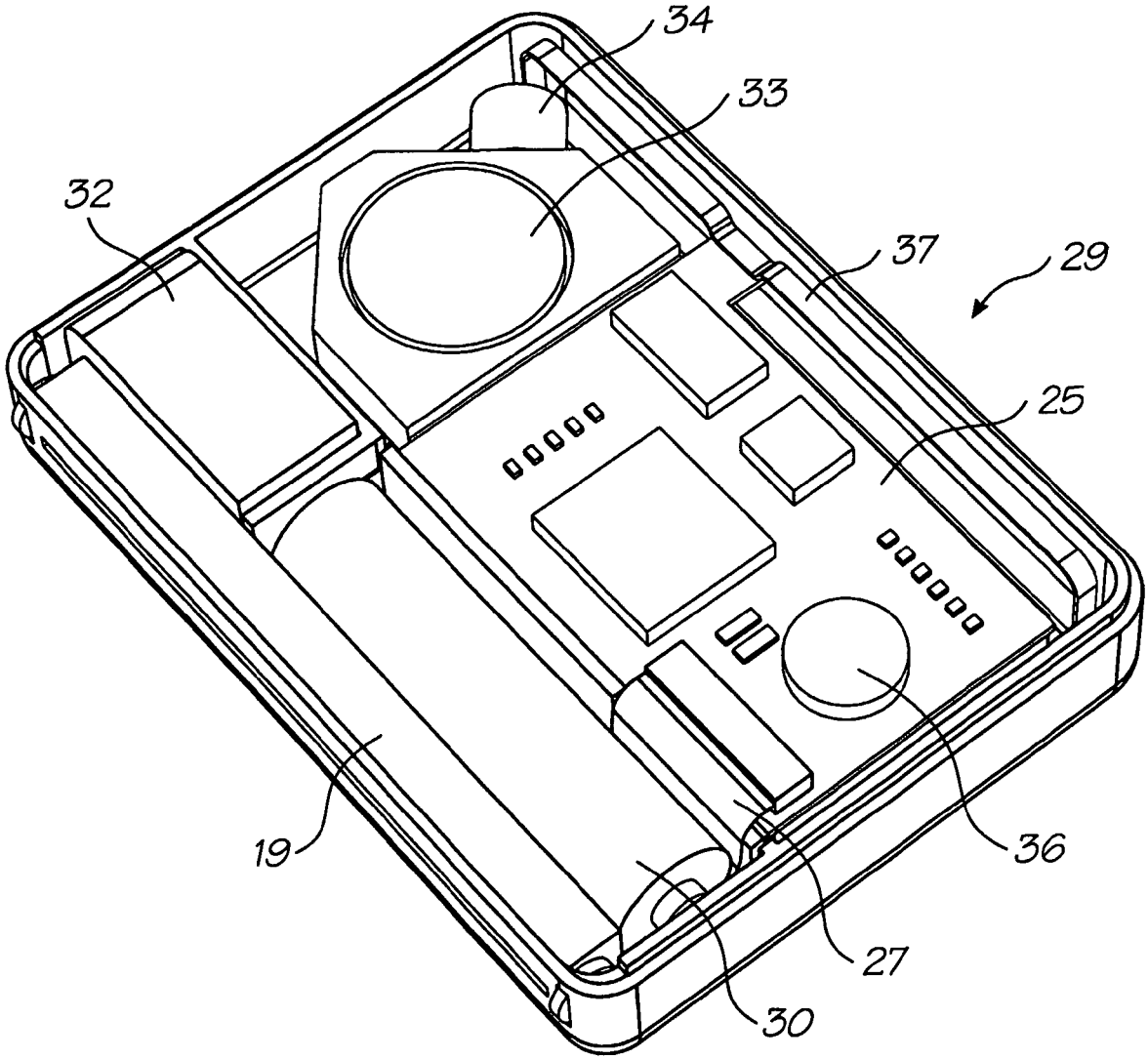
FIG. 9 is a schematic perspective view of the pager with a back cover removed.

Details of the electronics 29 can be better seen in FIG. 9. That is, attached to the underside of PCB 25 is a printer chip 35 serving to the control the operation of the printhead 19 and perhaps to store digital image data to be printed. However, the digital data might be stored on another chip or chips or might be stored on a memory card or other storage unit. The flex PCB 27 is shown attached to PCB 25 in this figure. A coin battery 36 such as a lithium ion battery is also attached to the PCB 25. This might serve to maintain any memory data when the main battery 30 is removed or drained. An antenna 37 associated with the pager unit is also depicted. Also associated with the pager unit is a vibrating magnet 33 and a speaker 34. Features 33, 34 and 37 will not be described in detail as they can be standard pager components.

In use, the pager unit receives messages via the antenna 37 whereupon the speaker 34 makes a tone and/or the vibrating magnet 33 vibrates the pager to indicate that a message has been received. The message can be viewed through the display window 23 upon manipulation of buttons 21. Software controlling the LCD can display a print option whereupon the YES/GO button 15 can be depressed to initiate a printing mode, or the NO/STOP button 16 can be pressed if a print-out is not required.

Apart from text messages, the pager might receive a graphic image. Text and/or a graphic image can be printed upon the sheet of print media 12 by grasping the pager unit 10 and rolling it across the page with optical encoder wheel 18 and idler wheel 20 in contact therewith. When the unit is drawn across the page, the printhead 19 deposits droplets of ink upon the page to produce the image 11. The image 11 can be monochrome or color, depending on the type of printhead employed and the configuration of the ink cartridge and ink delivery means. For color printing, multiple-color inks can be employed and the printhead of cross-referenced application Ser. No. 10/503,900 can be employed.

I claim:

1. A pager comprising:

a housing;

a digital storage device adapted to store one or both of text and image data received by the pager via radio communication;

a printer located within the housing and configured to:

(a) receive digital information from the digital storage device; and (b) print one or both of text and an image on print media external to the printer as the pager is moved over said print media by a user; and (c) engage with a replaceable ink cartridge; and a replaceable power supply for powering the digital storage device and printer, wherein the housing comprises a removable cover for access to both said replaceable power supply and ink cartridge.

2. The pager of claim 1 further comprising an antenna via which one or both of said text data and said image data is received.

3. The pager of claim 1 wherein said printer comprises a drop-on-demand color inkjet printhead.

4. The pager of claim 3 wherein the replaceable ink cartridge has a chip for communicating the presence of the ink cartridge in the housing with the printhead.

5. The pager of claim 1 wherein the power supply includes a battery removable from the pager.

6. The pager according to claim 1 further comprising a display screen adapted to display one or both of the text and the image.

7. The pager according to claim 1 further comprising user operable buttons for controlling said printer.

* * * * *